US006379764B1

(12) United States Patent
Pusateri et al.

(10) Patent No.: US 6,379,764 B1
(45) **Date of Patent: *Apr. 30, 2002**

(54) METHOD AND APPARATUS FOR PLACING LINERLESS REPOSITIONABLE SHEETS DIRECTLY ONTO ADVERTISING SIGNATURES

(75) Inventors: Michael A. Pusateri, Burr Ridge; Ricky M. Boldin, Midlothian, both of IL (US)

(73) Assignee: 3M Innovative Properties Company, St. Paul, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/963,147

(22) Filed: Nov. 3, 1997

Related U.S. Application Data

(62) Division of application No. 08/095,722, filed on Jul. 21, 1993, now abandoned.

(51) Int. Cl.[7] ..... B42D 15/00

(52) U.S. Cl. ..... 428/40.1; 283/81; 428/40.2; 428/42.1; 428/42.2; 428/42.3; 428/194; 428/906; 428/914

(58) Field of Search ..... 428/40.1, 40.2, 428/42.1, 42.2, 42.3, 906, 194, 914; 283/81

(56) References Cited

U.S. PATENT DOCUMENTS

| | | | | |
|---|---|---|---|---|
| 2,531,631 A | * | 11/1950 | Jordan | 428/194 |
| 2,555,325 A | | 6/1951 | Doane | 216/30 |
| 2,606,681 A | | 8/1952 | Ridenour | 216/28 |
| 2,715,975 A | | 8/1955 | Doane et al. | 216/28 |
| 2,889,029 A | | 6/1959 | Ridenour | 198/35 |

(List continued on next page.)

FOREIGN PATENT DOCUMENTS

| | | |
|---|---|---|
| EP | 0 370 642 | 5/1990 |
| EP | 0 673 839 A1 | 9/1995 |
| EP | 0 701 944 A2 | 3/1996 |
| WO | WO 94/14614 | 7/1994 |
| WO | 96/10489 | 4/1996 |
| WO | 96/13435 | 5/1996 |

*Primary Examiner*—Nasser Ahmad
(74) *Attorney, Agent, or Firm*—Michael A. Hakamaki

(57) ABSTRACT

Method and apparatus 40 for securing a cut sheet 14 bearing a repositionable pressure-sensitive adhesive 140 directly to an advertising signatures 12. A linerless elongated sheeting 54 having a backside 56 partially coated with a repositionable adhesive 140 is transported to a cutting mechanism 60 without having the adhesive 140 make substantial contact with the apparatus 40. The linerless elongated sheeting 54 is severed by the cutting mechanism 60 to provide a cut repositionable sheet 14 which is subsequently adhered to the advertising signature 12.

25 Claims, 7 Drawing Sheets

U.S. PATENT DOCUMENTS

| | | | | | |
|---|---|---|---|---|---|
| 2,925,167 | A | | 2/1960 | Lindberg | 198/35 |
| 2,956,804 | A | | 10/1960 | Ridenour | 271/32 |
| 3,005,565 | A | | 10/1961 | Doane et al. | 156/571 |
| 3,039,517 | A | | 6/1962 | Doane et al. | 156/511 |
| 3,072,253 | A | | 1/1963 | Ridenour | 209/111.5 |
| 3,111,084 | A | | 11/1963 | Ridenour et al. | 101/47 |
| 3,341,390 | A | | 9/1967 | Kirk | 156/511 |
| 3,537,194 | A | * | 11/1970 | Engle | 428/194 |
| 3,556,909 | A | | 1/1971 | Stegman | 156/521 |
| 3,560,299 | A | | 2/1971 | Schneider | 156/354 |
| 3,713,948 | A | | 1/1973 | Kluger | 156/351 |
| 3,751,324 | A | | 8/1973 | Enskat | 156/521 |
| 3,883,380 | A | | 5/1975 | Kirk et al. | 156/60 |
| 3,883,385 | A | | 5/1975 | Kirk et al. | 156/352 |
| 3,885,705 | A | | 5/1975 | French | 221/211 |
| 3,888,725 | A | | 6/1975 | French | 156/556 |
| 3,984,277 | A | | 10/1976 | French et al. | 156/497 |
| 4,024,011 | A | | 5/1977 | Crankshaw et al. | 156/299 |
| 4,046,613 | A | | 9/1977 | Kucheck et al. | 156/249 |
| 4,124,429 | A | | 11/1978 | Crankshaw | 156/364 |
| 4,124,435 | A | | 11/1978 | Stump et al. | 156/521 |
| 4,201,621 | A | | 5/1980 | Crankshaw et al. | 156/567 |
| 4,210,484 | A | | 7/1980 | Crankshaw et al. | 156/542 |
| 4,261,788 | A | | 4/1981 | McClung | 156/541 |
| 4,337,108 | A | | 6/1982 | Crankshaw et al. | 156/285 |
| 4,354,894 | A | | 10/1982 | Lewis et al. | 156/517 |
| 4,390,386 | A | | 6/1983 | Bartl | 156/235 |
| 4,421,587 | A | | 12/1983 | Guenther et al. | 156/256 |
| 4,447,481 | A | * | 5/1984 | Holmberg | 428/194 |
| 4,473,429 | A | | 9/1984 | Crankshaw | 156/483 |
| 4,475,978 | A | | 10/1984 | Bartl | 156/497 |
| 4,491,498 | A | | 1/1985 | Harris et al. | 156/497 |
| 4,521,267 | A | * | 6/1985 | Jacobson | 428/194 |
| 4,566,933 | A | | 1/1986 | Crankshaw et al. | 156/444 |
| 4,589,943 | A | | 5/1986 | Kimball et al. | 156/256 |
| 4,612,079 | A | | 9/1986 | Ostrow | 156/497 |
| 4,680,210 | A | * | 7/1987 | Corcoran | 428/42.3 |
| 4,707,211 | A | | 11/1987 | Shibata | 156/354 |
| 4,784,714 | A | | 11/1988 | Shibata | 156/354 |
| 4,840,696 | A | | 6/1989 | Krasuski et al. | 156/353 |
| 4,842,303 | A | | 6/1989 | Molenda | 281/38 |
| 4,886,566 | A | | 12/1989 | Peyre | 156/361 |
| 4,994,322 | A | | 2/1991 | Delgado et al. | 428/343 |
| 5,068,004 | A | | 11/1991 | Moll | 156/494 |
| 5,122,108 | A | | 6/1992 | Segalowitz et al. | 493/344 |
| 5,154,962 | A | | 10/1992 | Mertens et al. | 428/40 |
| 5,236,535 | A | | 8/1993 | Smith | 156/250 |
| 5,282,649 | A | * | 2/1994 | Williams | 283/56 |
| 5,283,091 | A | | 2/1994 | Darvell et al. | 428/40 |
| 5,324,078 | A | | 6/1994 | Bane | 283/81 |
| 5,358,281 | A | * | 10/1994 | Greig | 283/81 |
| 5,417,783 | A | | 5/1995 | Boreali et al. | 156/64 |
| 5,431,763 | A | | 7/1995 | Bradshaw | 156/256 |

* cited by examiner

METHOD AND APPARATUS FOR PLACING LINERLESS REPOSITIONABLE SHEETS DIRECTLY ONTO ADVERTISING SIGNATURES

This is a divisional of now abandoned application Ser. No. 08/095,722, filed Jul. 21, 1993.

TECHNICAL FIELD

This invention pertains to a method for placing linerless repositionable sheets directly onto advertising signatures and to an apparatus useful for carrying out the method.

BACKGROUND OF THE INVENTION

An advertising signature is an insert that is placed in a magazine and comprises a plurality of pages, typically rectangular pieces of paper having advertising printed thereon and being folded over to form a registration edge. When placed in a magazine, the advertising signature is bound to the other magazine pages along the registration edge.

To further some of the goals of advertising, including advertiser name retention and promotion of product sales, advertising signatures have been provided with repositionable labels that contain information such as the name and telephone number of the advertiser or a coupon for a price discount. The labels are repositionable so that they can be removed from the advertising signature and adhered at another location (for example, a desk or refrigerator) to remind the reader to call the advertiser or to use the coupon at a later date.

Many of the labels that have been placed on advertising signatures have a repositionable pressure sensitive adhesive (RPSA) coated over the whole backside of the label. Labels that have a RPSA coated over their whole backside are typically carried on a liner before being adhered to an advertising signature. The labels on the liner are supplied to an apparatus which separates the label from the liner and adheres the label to an advertising signature. The following patents disclose methods and apparatus for separating labels from a liner so that the labels can be subsequently adhered to a substrate: U.S. Pat. Nos. 4,943,337; 4,685,982; 4,612,079; 4,566,933; 4,475,978; 4,473,429; 4,390,386; 4,337,108; 4,314,869; 4,261,788; 4,255,220; 4,210,484; 4,201,621; 4,124,429; 4,024,011; 4,046,613; 3,984,277; 3,888,725; 3,885,705; 3,806,395; and 3,751,324. In the methods and apparatus disclosed in these patents, the label is separated from the liner by a peeler bar, and the label is subsequently adhered to a substrate (that could be an advertising signature), typically, by a blast of air; see e.g. U.S. Pat. Nos. 4,685,982, 4,612,079, 4,475,978, and 4,390,386. The liner, which previously supported the label, often is rewound on a take-up reel and is subsequently discarded as waste. These methods and apparatus have drawbacks in that they generate waste in the form of a useless liner, require additional equipment on the apparatus to remove the label and store the liner, for example, a peeler bar and take-up reel, and use excess quantities of adhesive by having the whole backside of the label coated with a RPSA.

In another approach to promote an advertisement in an advertising signature, a backer card is employed to secure a repositionable, information-containing sheet to an advertising signature. See U.S. Pat. No. 4,842,303. The backer card has a registration edge which is aligned with the registration edge of the advertising signature. The repositionable sheet of paper has a narrow band of RPSA coated on one surface adjacent to an edge of the repositionable sheet. The repositionable sheet is adhered along the registration edge of the backer card by the narrow band of RPSA. The combination backer card and repositionable sheet is secured to an advertising signature by gluing the backer card to the advertising signature using, for example, a tipping machine.

Although the approach disclosed in U.S. Pat. No. 4,842,303 employs an information-containing sheet which only uses a narrow band of RPSA, it too has a number of drawbacks. One drawback is the need to employ a backer card to secure the repositionable sheet to an advertising signature. Another drawback is the need for a number of additional process steps to assemble the combination backer card/repositionable sheet before it is attached to an advertising signature. The additional process steps that have been used include: laminating the adhesive bearing sheet and backer card together in registry; cutting the laminated webs to a master sheet size (typically, 8.5 by 12 inches); stacking the cut master sheets; jogging the master sheets; cutting them into conventional sizes (for example, 4 inches by 6 inches); stacking the cut laminated sheets; and then shipping them to an inserter for attachment to an advertising signature.

To date it is believed that manual methods are the only publicly known methods for directly applying linerless repositionable sheets directly onto advertising signatures.

SUMMARY OF THE INVENTION

The present invention provides a new method and apparatus for applying repositionable sheets directly to an advertising signature.

The new method comprises the steps of:

(a) providing an advertising signature;

(b) providing a linerless repositionable sheet that has a first side partially coated with a repositionable pressure sensitive adhesive;

(c) adhering the linerless repositionable sheet directly to the advertising signature with an apparatus that has a sheet application mechanism, the sheet application mechanism adhering the linerless repositionable sheet to the advertising signature such that the first side of the linerless repositionable sheet is juxtaposed against the advertising signature; and (d) causing the advertising signature having the repositionable sheet adhered directly thereto to exit the apparatus.

The method of the invention can be carried out using the apparatus of the invention which in brief summary comprises:

(a) a cutting mechanism;

(b) a transport for moving an elongated linerless sheeting bearing an adhesive to the cutting mechanism;

(c) a mechanism capable of adhering a cut sheet bearing an adhesive to a substrate;

wherein the cutting mechanism cuts the elongated linerless sheeting into a first and second cut sheets such that no residual elongated linerless sheeting exits the apparatus after the elongated linerless sheeting has been cut.

The method and apparatus of the invention are advantageous in that repositionable sheets now can be rapidly placed on advertising signatures without using excess amounts of adhesive and a liner that is subsequently disposed of as waste. The prior art methods used slow manual methods, see U.S. Pat. No. 4,842,303 col. 1, 11. 22–40, employed a peeler bar to remove repositionable labels from a liner, see e.g. U.S. Pat. No. 4,475,978, or used a backer card to secure a repositionable sheet to an advertising signature, see U.S. Pat. No. 4,842,303 cols. 3–6. The invention thus provides a faster, more efficient method for applying repositionable sheets directly to advertising signatures without generating excess waste.

The above and other advantages of the invention are more fully shown and described in the drawings and detailed description of this invention, where like reference numerals are used to represent similar parts. It is to be understood, however, that the description and drawings are for the purposes of illustration only and should not be read in a manner that would unduly limit the scope of this invention.

DETAILED DESCRIPTION OF PREFERRED EMBODIMENTS

In describing the preferred embodiments of the invention, specific terminology will be used for the sake of clarity. The invention, however, is not intended to be limited to the specific terms so selected, and it is to be understood that each term so selected includes all the technical equivalents that operate similarly.

Figure 1:
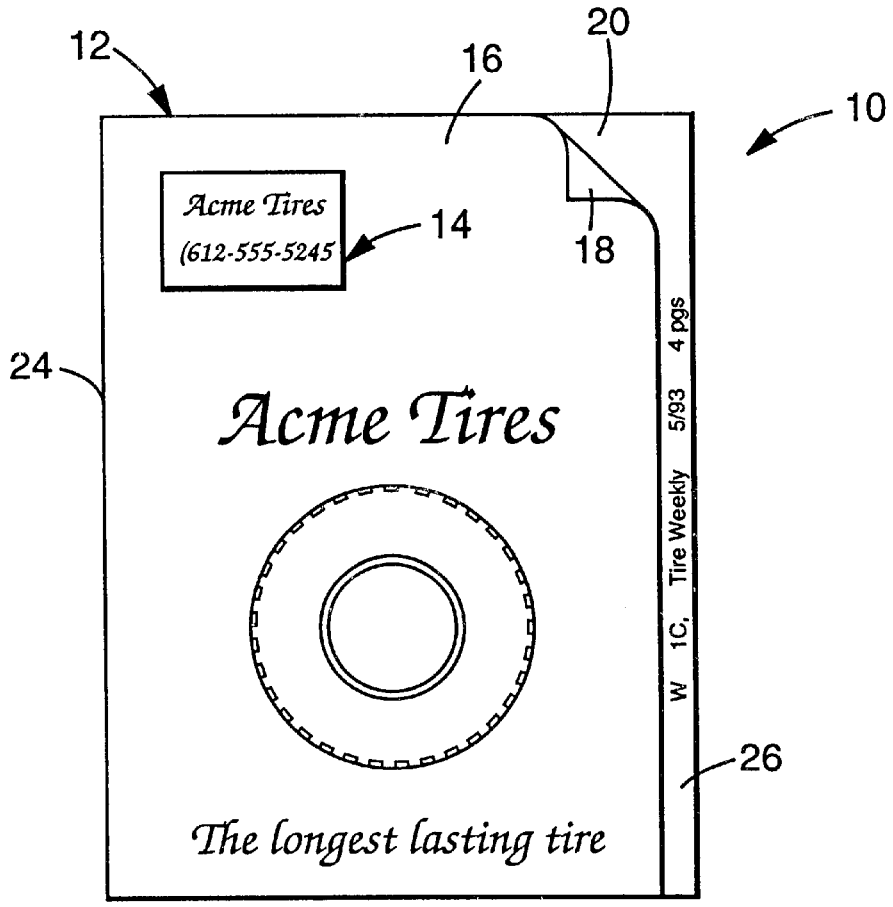
FIG. 1 is a front view of an advertising insert 10 comprising an advertising signature 12 having a repositionable sheet 14 adhered to a page 16 of the advertising signature 12.
Figure 2:
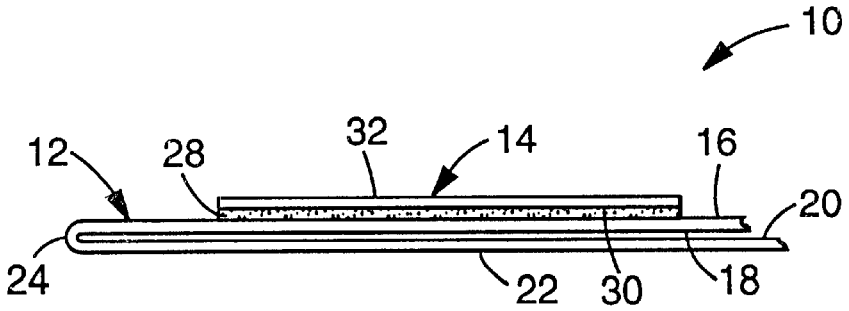
FIG. 2 is an end view of the advertising insert 10 shown in FIG. 1.

FIGS. 1 and 2 illustrate an advertising insert 10 that includes an advertising signature 12 and a repositionable sheet 14. The term "repositionable" means the sheet can be adhered to and removed from a flat, clean solid surface at least two times without substantially losing tack. Preferably, the sheet can be adhered to and removed from a flat, clean solid surface at least 10 and more preferably at least 20 times without substantially losing tack. The primary problem associated with these types of adhesives have been microsphere loss, i.e., microsphere transfer to the substrate. This typically has been addressed by the use of a binder or primer for the microspheres. Conventional adhesives for adhering paper and other like materials to substrates, while having many desirable features, also have inherent drawbacks. For example, while some such adhesives may permit removal from a substrate to which it has been adhered, they do not permit rebonding of the paper to the substrate. Conversely, other adhesives possess a tack which may be so aggressive as to cause the paper to tear on removal. Aerosol spray adhesives have recently found commercial importance in the graphic arts for adhering paper to various substrates, as well as numerous other uses. For instance they permit paper to be removed from a substrate to which it is adhered, without tearing; however, they do not permit rebonding. Advertising signature 12 has a plurality of pages: a first top page 16, a second or opposite inside page 18, a third or juxtapositioned inside page 20, and a fourth or rear page 22. The signature pages 16, 18, 20, and 22 can be printed on a single sheet which is folded at 24. Additional pages can be provided in a signature by, for example, increasing the number of folded sheets. Thus, the total number of pages in a signature often is a multiple of four (4, 8, 12, 16, 24 . . . ). Although the sheet may be folded in the center to form an advertising signature, the sheet typically is folded off-center to provide a marginal edge or lap 26 along which distribution instructions are provided to the bindery. The repositionable sheet 14 is secured directly to the advertising signature by the RPSA 28 coated partially on the first or back side 30 of the sheet 14. The term "directly" means there is no medium (such as a backer card) disposed between the RPSA on the repositionable sheet and the advertising signature. Repositionable sheet 14 has a second or top side 32 onto which information can be printed which corresponds to or further emphasizes information printed on the advertisement on the page where the repositionable sheet is adhered. As illustrated, the repositionable sheet 14 can have the name and phone number of the advertiser printed on the top side of the sheet 14.

A repositionable sheet can be a Post-it™ Brand note sold by 3M™ of St. Paul, Minn. Post-it™ Brand notes include a sheet of paper that has an adhesive partially coated on one side thereof. The sheet of paper typically is an unsaturated paper, which is a paper that is not impregnated with a resin. However, the substrate or backing useful for the invention can in general be any material which is not so porous as to allow the binder material to permit the backing and prevent a supporting anchoring film from being maintained. Exemplary substrates for forming the sheet include films such as polyesters, cellulose acetate, and polyvinyl chloride, glass, wood, vinyl copolymers and urethane cast closed cell foams, paper, cellulose acetate, ethyl cellulose, woven or nonwoven fabric formed of synthetic or natural materials, metal, metallized polymeric film, ceramic sheet material, and the like. Useful substrates also include bonded composites, such as paper bonded to foam, films bonded to foam or paper, etc. Although the adhesive typically is coated as a narrow band adjacent to an edge of the sheet, it is possible to envision other embodiments where only corners or other portions of the back side of the sheet are coated with a repositionable pressure sensitive adhesive. The amount of adhesive employed on the backside of the repositionable sheet should be sufficient to enable the sheet to be adhered to a clean flat surface. In some instances it may be advantageous to employ an intermediate primer layer between the substrate and the binder layer. The art of priming substrates to allow wetting or bonding of a variety of coatings is well known.

RPSAs are well known in the art as evidenced by U.S. Pat. Nos. 5,045,569, 4,988,567, 4,994,322, 4,786,696, 4,166,152, 3,857,731, and 3,691,140, the disclosures of which are incorporated here by reference. A RPSA typically comprises polymeric microspheres having an average diameter of at least about one micrometer. The microspheres are inherently tacky and typically comprise at least about 70 parts by weight of an alkyl acrylate or alkyl methacrylate ester. The tacky microspheres provide a pressure-sensitive adhesive which has a low degree of adhesion permitting separation, repositioning, and rebonding of adhered objects. Further, the tacky spheres resist permanent deformation, regaining their spherical shape upon release of pressure. Tack properties of the microspheres may be altered by inclusion of various resins in the solvent or aqueous suspensions of microspheres. Properties of the pressure-sensitive adhesives of the invention may be altered by addition of tackifying resin and/or plasticizer. It is also within the scope of this invention to include various other components, such as pigments, fillers, stabilizers, or various polymeric additives. A majority of the microspheres may contain interior voids, typically, at least about 10 percent of the diameter of the microsphere. RPSAs are tacky to the touch and typically demonstrate a peel adhesion of approximately 10 to 300 gram/centimeters (g/cm), more typically approximately 50 to 250 g/cm, and even more typically about 70 to 100 g/cm. Peel adhesion is the force required to remove an adhesive coated flexible sheet material from a test panel measured at a specific angle and rate of removal. This force is expressed in grams per centimeters (cm) width of coated sheet. The procedure for determining peel adhesion is as follows: A strip 1.27 cm in width of the adhesive coated sheet is applied to the horizontal surface of a clean glass test plate with at least 12.7 lineal cm in firm contact. A 2 kg hard rubber roller is used to apply the strip. The free end of the coated sheet is doubled back nearly touching itself so the angle of removal will be 180°. The free end is attached to the adhesion tester scale. The glass test plate is clamped in the jaws of a tensile testing machine which is capable of moving the plate away from the scale at a constant rate of 2.3 meters per minute. The scale reading in grams is recorded as the coated sheet is peeled from the glass surface. The data is reported as the average of the range of numbers observed during the test.

A shear strength measured at five minutes is preferable for the adhesive application of the present invention. Shear strength is a measure of the cohesiveness or internal strength of an adhesive. It is based upon the amount of force required to pull an adhesive strip from a standard flat surface in a direction parallel to the surface to which it has been affixed with a definite pressure. It is measured in minutes required to pull a standard area of adhesive coated sheet material from a stainless steel test panel under stress of a constant, standard load. The procedure for determining shear strength is as follows: A strip of adhesive coated sheet material is applied to a stainless steel panel such that a 1.27 cm by 1.27 cm portion of the strip is in firm contact with the panel with one end portion of the strip being free. The panel with the coated strip attached is held in a rack such that the panel forms an angle of 178° with the extended strip free end which is tensioned by application of a force of 200 grams applied as a hanging weight from the free end of the coated strip. The 2° less than 180° is used to negate any peel forces, thus insuring that only the shear forces are measured, in an attempt to more accurately determine the holding power of the adhesive strip being tested. The time elapsed for each adhesive coated sheet to separate from the test panel is recorded as shear strength. Peel adhesion and shear strength can be determined according to the tests outlined in U.S. Pat. No. 5,045,569.

It is an object of this invention to provide an acid-free microsphere-based repositionable pressure-sensitive adhesive for use when acids would cause problems with the substrate such as discoloration, i.e., photographs, graphics, silk-screened printed matter, and the like. Microsphere-based adhesives are thought to perform well at least in part due to their "self-cleaning" nature, wherein substrate contaminants tend to be pushed aside and trapped between the microspheres as the adhesive is applied. Upon removal, the adhesive then still presents a relatively uncontaminated surface for reapplication to the substrate. A RPSA can be applied to a sheet using known methods including making a suspension of the microspheres and applying that suspension to the sheet by conventional coating techniques such as knife coating or Meyer bar coating or use of an extrusion dye (see U.S. Pat. No. 5,045,569 at column 7, lines 40–50). The microspheres can also be utilized in aerosol adhesives, they can be applied to substrates as an adhesive, they can be mixed with binder materials, and placed on substrates to provide repeatedly reusable adhesive surfaces, such as disclosed in U.S. Pat. No. 3,857,731, and they can be combined with a hot melt adhesive system, as is disclosed in Loder et al. U.S. Pat. No. 4,049,483.

Figure 3:
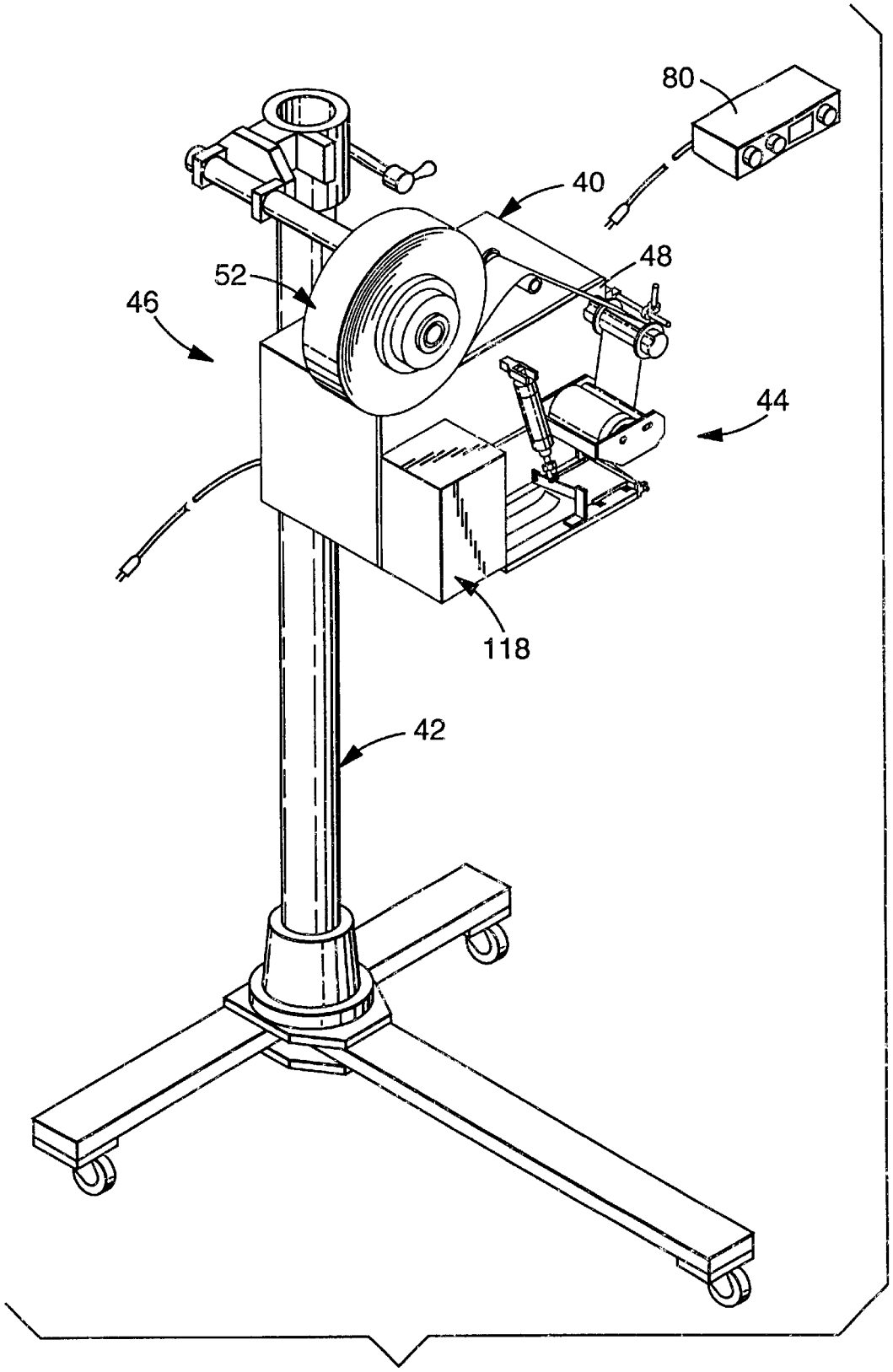
FIG. 3 is an isometric view of an apparatus 40 in accordance with the present invention mounted to a portable stand 42.

FIG. 3 illustrates in perspective an apparatus 40 useful for carrying out the method of the invention. Apparatus 40 is supported by a portable stand 42 that allows the apparatus to be positioned over a transport such as an endless belt or conveyor system (not shown) which can supply a substrate such as an advertising signature 12 to apparatus 40. Apparatus 40 has an operating side 44 and a drive mechanism side 46 separated by and supported by a panel or housing 48.

Figure 4:
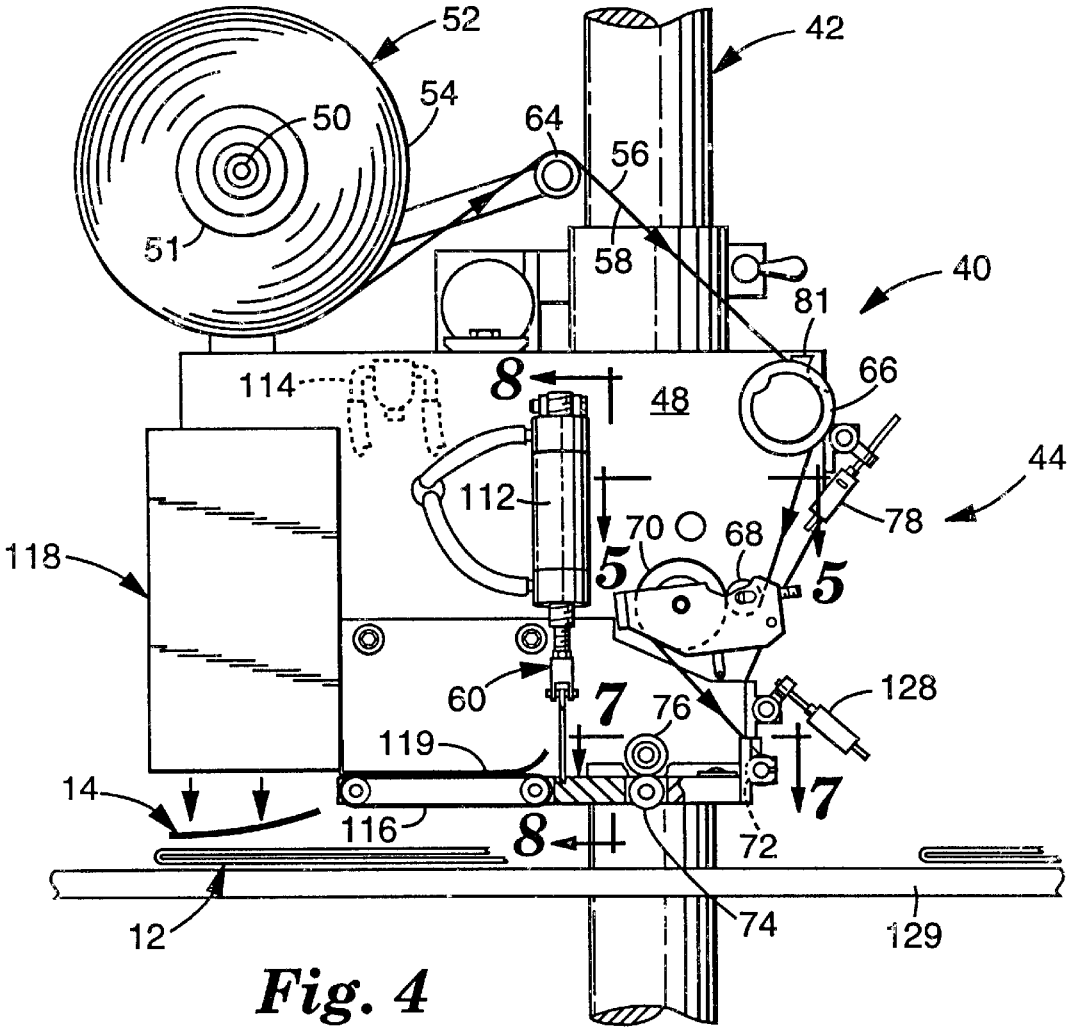
FIG. 4 is a front elevational view of apparatus 40 in accordance with the present invention.

In FIG. 4, operating side 44 of apparatus 40 is best shown. Operating side 44 of apparatus 40 is the side where the repositionable sheets are handled for placement on a substrate. On operating side 44 there is a spindle 50 onto which a bobbin 51 is mounted that holds a roll 52 of elongated, linerless repositionable sheeting 54. The repositionable sheeting 54 is referred to as "elongated" because it is not yet cut into a number of individual repositionable sheets, and thus the length of the elongated repositionable sheeting, as its name implies, is much greater than its width, the latter of which typically is less than about five inches (13 centimeters (cm). The term "linerless" is used herein to mean an adhesive on a sheet is exposed from the time the sheet is supplied with the adhesive secured thereto (e.g., comes off a supply roll) to an apparatus for adhering the sheet to a substrate and the time the repositionable sheet is adhered to the substrate. A repositionable sheet is not considered to be linerless when a liner covering the adhesive is removed to expose the adhesive just prior to adhering the sheet to a substrate.

The elongated, linerless repositionable sheeting 54 is positioned on the roll 52 with the back or adhesive-bearing side 56 towards the center of the roll 52 and the top or information-bearing side 58 towards the periphery. The elongated, linerless repositionable sheeting 54 travels through. a series of rollers before reaching a cutting mechanism 60, where the elongated sheet 54 is cut transverse to the direction of sheet movement to provide a cut repositionable sheet 14 of desired length. As the term is used herein, "cut" means the sheet has been completely severed from a larger sheeting. Typically, sheet 14 will be cut to a size of less than 100 square inches (645 $cm^2$). More typically, cut sheets have a size in the range of approximately 1 to 30 square inches (6 to 194 $cm^2$), and even more typically in the range of about 2.5 to 25 square inches (16 to 161 $cm^2$). Cut repositionable sheets frequently measure about 3 inches by about 5 inches (7 by 13 cm) or about 4 inches by about 6 inches (10 by 15 cm). Other common sizes are about 1.5 inches by about 2 inches (3 cm by 5 cm).

Figure 11:
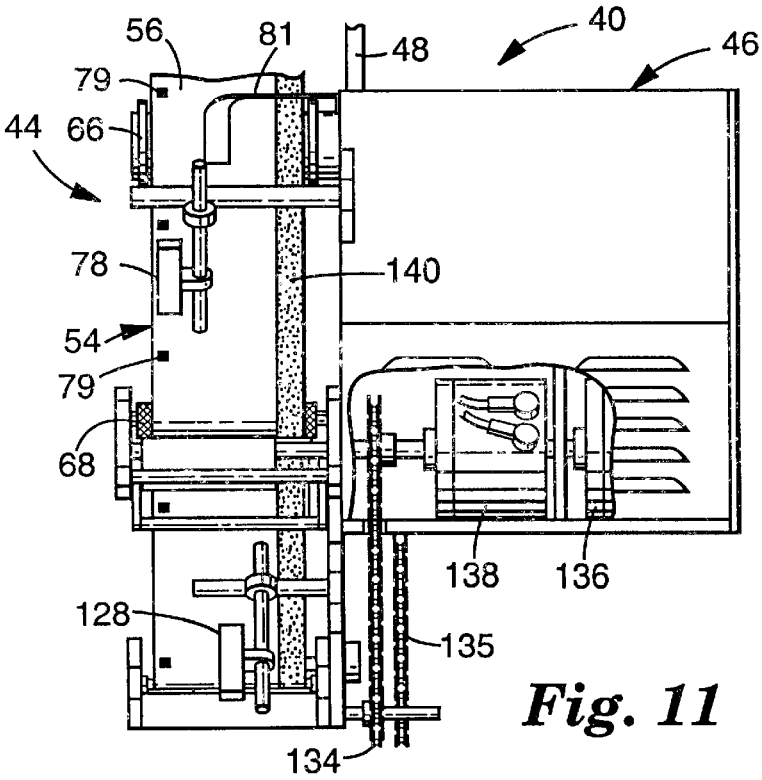
FIG. 11 is a right side elevational view of apparatus 40 in accordance with the present invention taken along lines 11—11 of FIG. 10.

The elongated, linerless repositionable sheeting 54 travels to the cutting mechanism 60 by passing over a first idler roller 64, second idler roller 66, between a pinch roller 68 and a drive roller 70, over a third idler roller 72, and between a second drive roller 74 and a second pinch roller 76. A sensor 78 such as a photoelectric switch (for example, an OMRON model number E3S-VS1E42, Japan) may be used to detect eye marks 79 (FIG. 11) on the backside 56 of the elongated, linerless repositionable sheeting 54 and to instruct the apparatus to advance the sheeting 54. The sensor 78 sends a signal to a photoelectric controller 80 (FIG. 3), for example a Compac™ Corporation, Label-Aire, Inc., (Fullerton, Calif.) Model No. D84-A 535 controller (believed to be made by Tri-Tronics Company, Inc.). The controller 80 in turn instructs the drive roller 70 to stop the advancement of the elongated, linerless repositionable sheeting 54 and then instructs the cutting mechanism to cut sheeting 54 to form a cut repositionable sheet 14. As shown in FIG. 11, each eye mark 79 is large enough to be optically detectable, and the eye marks 79 are equally longitudinally spaced without interference in between by other marks that may be detected by the sensor 78 by mistake. The preprinted images on sheet 14 (see FIG. 1) are printed on the opposite side of the sheet from the eye marks 79 and adhesive 140, and the sheet 14 itself is preferably opaque. The elongated, linerless repositionable sheeting 54 preferably is kept taut in the sensing region between idler roller 66 and pinch roller 68 so that the eye marks 79 on elongated repositionable sheeting 54 do not go undetected by sensor 78. A spring or other suitable means may be employed to keep sheeting 54 taught between rollers 66 and 68. The elongated, linerless repositionable sheeting 54 is cut along a line transverse to the direction of advancement of sheeting 54. With the exception of the very first sheet cut from the elongated linerless repositionable sheeting 54, each cut may define the trailing edge of the immediately cut sheet and the leading edge of the next cut sheet. Thus, virtually all of the linerless repositionable sheeting can be used to form cut repositionable sheets, and the generation of excess waste may be avoided. In addition, no elongated sheeting remains which exits the apparatus after the sheeting has been cut, and thus no take-up reel is needed to gather residual or unused elongated sheeting or liner.

Figure 5:
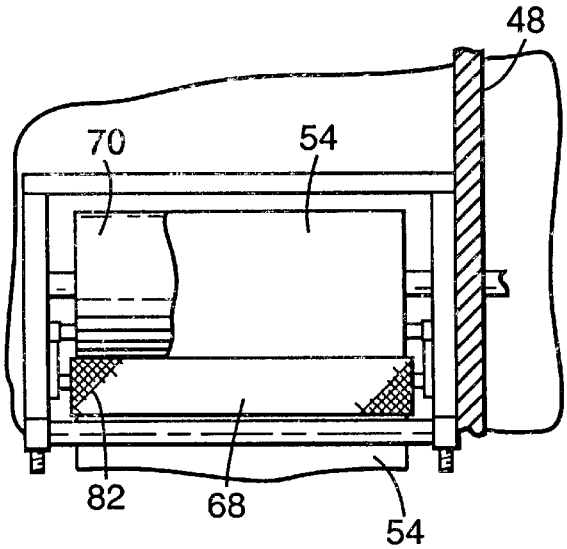
FIG. 5 is a top view of drive roller 70 and pinch roller 68 in accordance with the present invention taken along lines 5—5 of FIG. 4.

As best shown in FIG. 5, the elongated, linerless repositionable sheeting 54 is firmly pressed against drive roller 70 by pinch roller 68, preferably a knurled 82 pinch roller, so that sheeting 54 does not slip when the drive roller 70 advances the elongated, linerless repositionable sheeting 54. The drive roller 70 preferably has an outer surface which is made from a material that has a high static coefficient of friction such as rubber. It is important that the elongated, linerless repositionable sheeting 54 does not slip when the drive roller 70 advances, otherwise the sheeting 54 would not be cut to the proper size and some of the information may be severed from the cut repositionable sheet.

Figure 6:
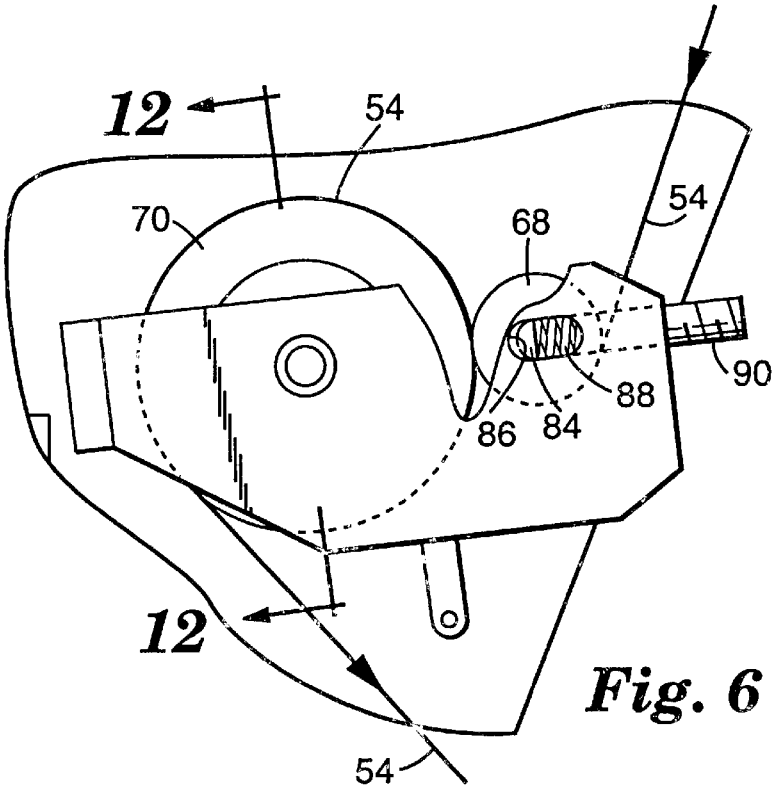
FIG. 6 is a side view of drive roller 70 and pinch roller 68 in accordance with the present invention.

FIG. 6 shows in detail how the pinch roller 68 forces the elongated, linerless repositionable sheeting 54 against drive roller 70. The axle 84 of pinch roller 68 rests in an elongated slot 86 where a spring 88 is disposed which forces axle 84 and ultimately the pinch roller 68 towards the drive roller 70. The force exerted by spring 88 can be adjusted by turning a threaded set screw 90.

Figure 7:
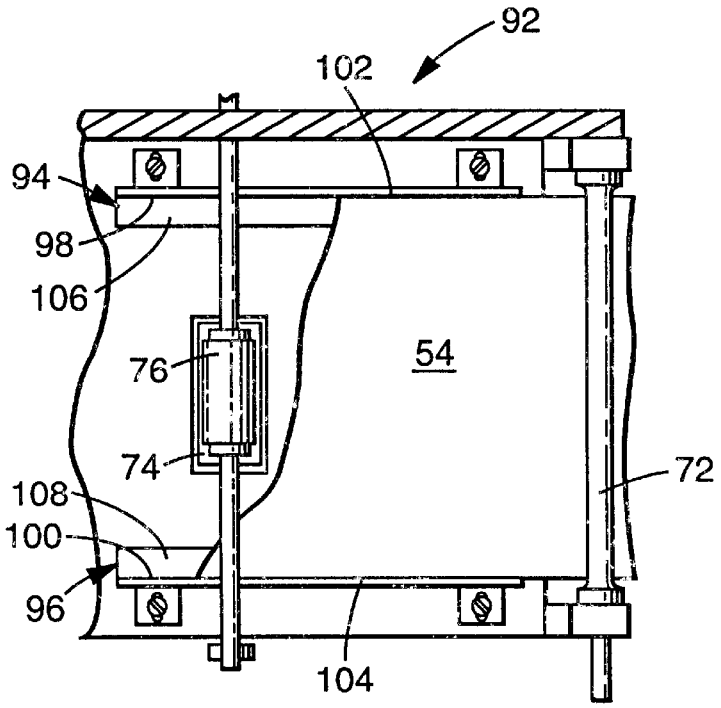
FIG. 7 is a top view of precutting guide 92 in accordance with the present invention taken along lines 7—7 of FIG. 4.

Before being cut, the elongated, linerless repositionable sheeting 54 is aligned by a precutting guide 92, best shown in FIG. 7. Precutting guide 92 comprises first and second guiding members 94 and 96, respectively. Each guiding member has wall 98, 100 that is disposed perpendicular to the elongated, linerless repositionable sheeting 54. Each wall 98, 100 abuts first and second edges 102, 104 of sheeting 54. Sheeting 54 is supported from beneath by rails 106; 108, which preferably have a top surface with a relatively low static coefficient of friction such as a polytetrafluoroethylene surface. Rail 106 preferably has a minimum surface area to reduce contact with the adhesive on the backside 56 of the elongated, linerless repositionable sheeting 54. The elongated, linerless repositionable sheeting 54 is supported in the center by drive roller 74 and is pressed against drive roller 74 by pinch roller 76. Drive roller 74 turns simultaneously with driver roller 70 and advances the sheeting into position for being cut.

Figure 8:
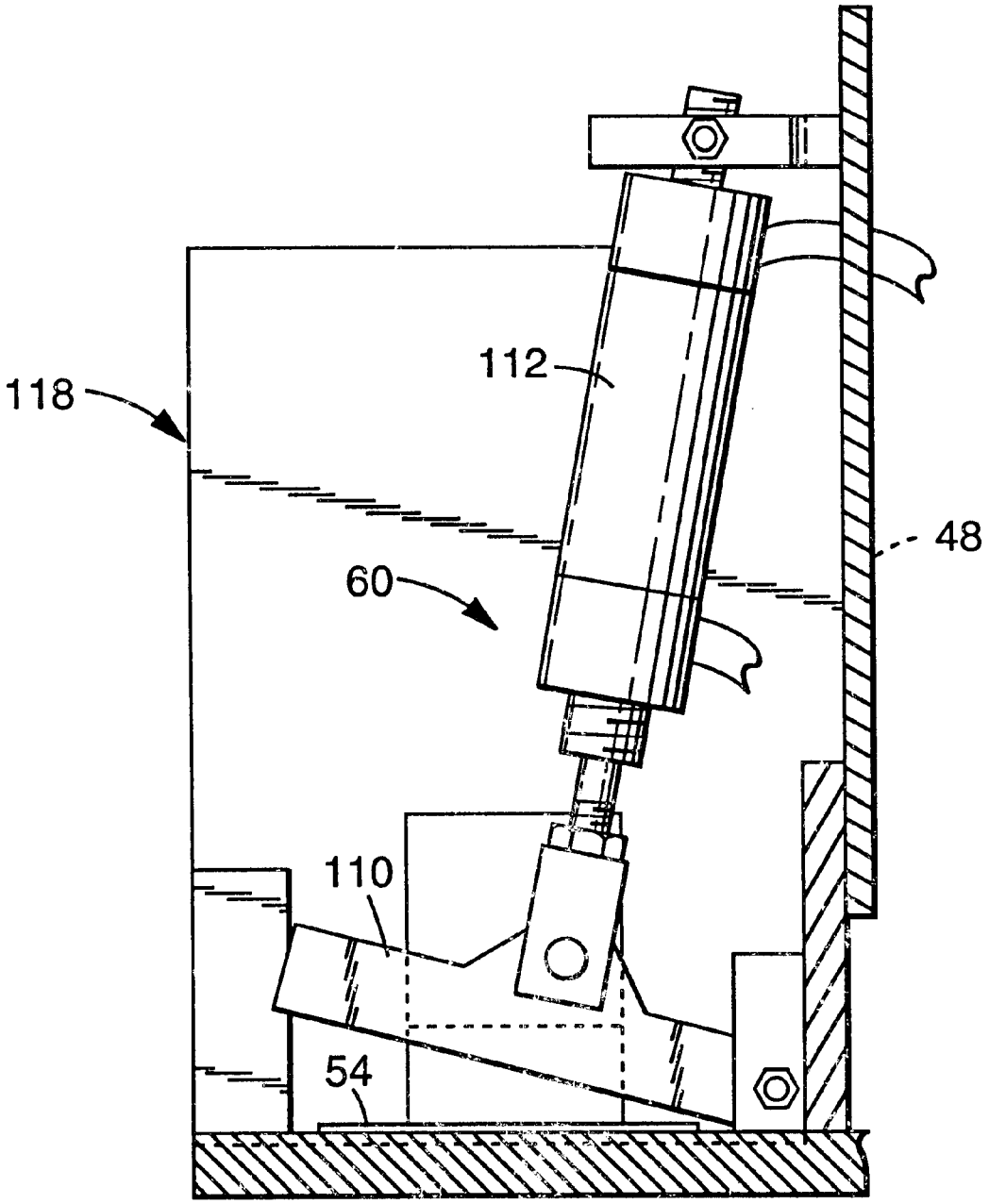
FIG. 8 is a front view of cutting mechanism 60 in accordance with the present invention taken along lines 8—8 of FIG. 4.

Reference is now made to FIG. 8 where cutting mechanism 60 is best illustrated. When drive roller 70 is instructed to advance, the elongated, linerless repositionable sheeting 54 passes beneath a blade 110 of cutting mechanism 60 over a distance equal to the desired length of a cut repositionable sheet. After the sheeting 54 has advanced, the cutting mechanism 60 is activated and blade 110 cuts the elongated, linerless repositionable sheeting 54. Blade 110 shown in FIG. 8 moves as a guillotine in an up and down direction perpendicular to the elongated repositionable sheeting 54. The guillotine can be activated by pneumatic device such as an air cylinder 112 powered by an air valve 114 such as a Mac (Wixon, Mich.) air valve, model number 9116 611C52. Air valve 114 is an electrical communication with controller 80, which instructs the valve to operate immediately after the drive roller 70 has advanced. Although a guillotine is illustrated as the cutting mechanism 60 for apparatus 40, other cutting mechanisms may be used. For example, a knife could be employed which moves across or transverse to the direction of advancement of sheeting 54.

Figure 9:
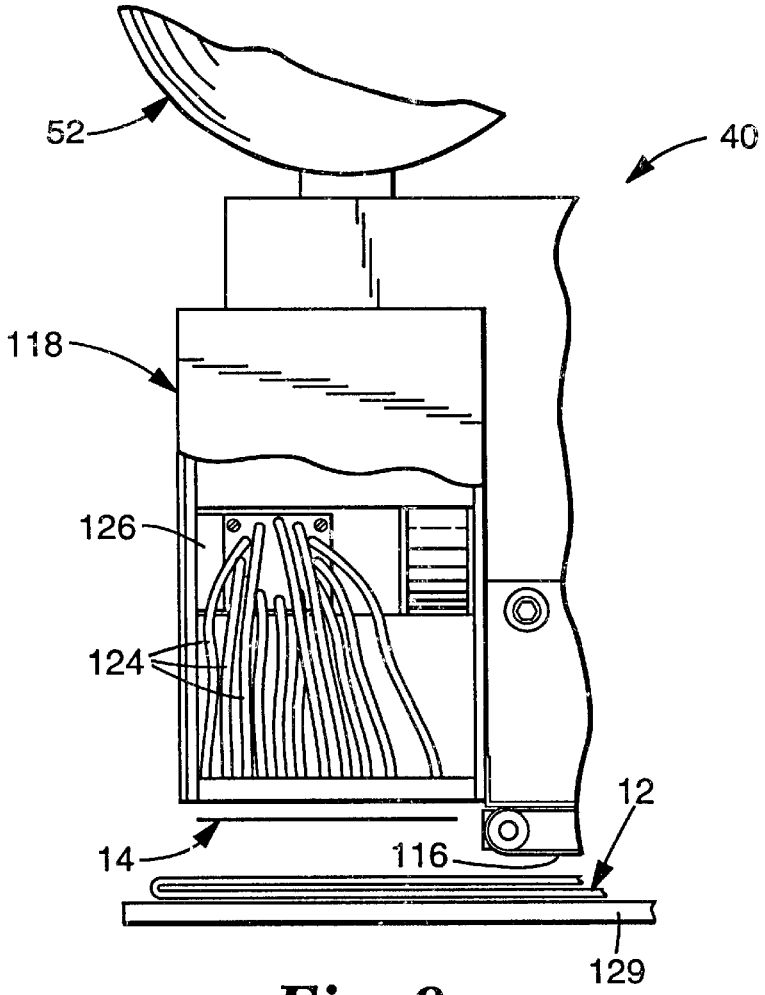
FIG. 9 is a partially broken front view of blower 118.

Reference is now made to FIG. 9 where the mechanism for applying a cut repositionable sheet 14 to an advertising signature 12 is shown. The mechanism for applying a cut repositionable sheet 14 to an advertising signature 12 may take the form of a blower 118. The cut repositionable sheet 14 may be delivered to the blower by an endless belt 116 (see also FIG. 4) or any other suitable means such as a conveyor or a movable platform capable of transporting the cut repositionable sheet 14 to the blower 118. A guide 119 (FIG. 4) can be provided to assist in the transport of cut sheet 14 to blower 118. The cut sheet is temporarily supported beneath blower 118 by a vacuum until the blower 118, as it name implies, blows a cut repositionable sheet 14 onto an advertising signature 12 to form an advertising insert 10. The blower 118 may comprise a plurality of tubes 124 which direct air from manifold 126 out a number of ports to exert substantially evenly distributed force on sheet 14. Blowers for placing labels on substrates are known in the art, see U.S. Pat. Nos. 4,390,386, 3,888,725, and 3,885,705. The blower can be, for example, an Air Tamp™ 609–0224 blower available from Lord Label Systems, Arlington, Tex. The blower 118 is activated by a second sensor 128 (FIG. 4). Sensor 128 can be a photoelectric switch similar to sensor 78. The sensor 128 detects an approaching advertising signature 12 on transport 129 (FIG. 4) and sends a signal to the controller 80 (FIG. 3), instructing the controller 80 to activate an electrical air valve which controls air flow through the blower 118. The air valve can be, for example, a MAC™, model number 9116 611C52, 24 volt DC valve. Air that passes through manifold 126 forces the cut repositionable sheet 14 onto signature 12. In lieu of a blower 118, other means such as a mechanical tamper, press, calendar, or the like may be used to adhere the cut repositionable sheet 14 to an advertising signature 12.

Figure 10:
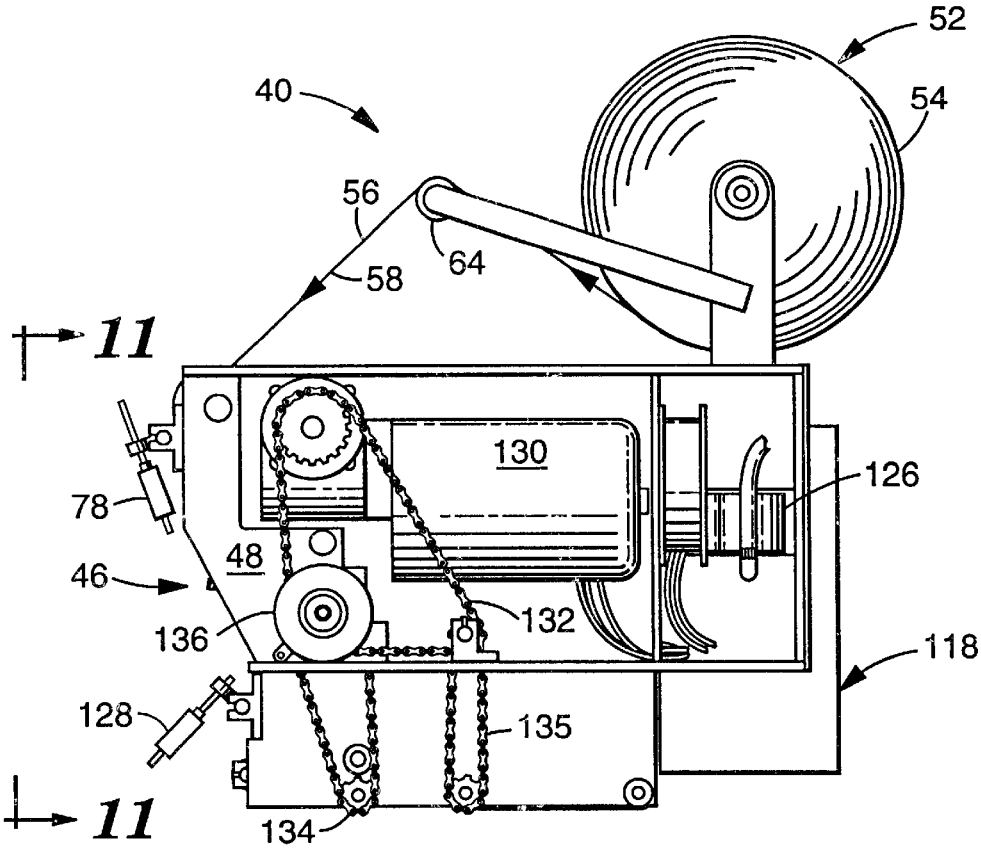
FIG. 10 is a back elevational view of apparatus 40 in accordance with the present invention.

Turning now to FIG. 10, the drive mechanism side 46 of apparatus 40 is illustrated. Drive mechanism 46 includes an electric motor 130 such as a fractional horse power gear motor, for example, a type NSI-34RH motor, Bodine Electric Company, Chicago, Ill. Electric motor 130 turns drive rollers 70 and 74 (FIG. 4) by use of at least one chain, belt, cable or other endless drive means. An endless chain 132 is illustrated for turning drive roller 70, and endless chain 134 is illustrated for turning driver roller 74. Endless chain 135 is employed to continuously turn belt 116 (FIG. 4). The advancement and halting of drive rollers 70 and 74 are accomplished by use of clutch 136 and brake 138 (FIG. 11). To advance the drive rollers 70 and 74, the controller 80 activates clutch 136, and then the elongated repositionable sheeting 54 moves forward the length of one cut sheet 14. The controller then activates the brake 138, and then the cutting mechanism 60 cuts the elongated sheeting 54.

In short, and with brief reference to FIGS. 4–10, the apparatus 40 performs the following steps to adhere a cut repositionable sheet 14 to an advertising signature 12. First, sensor 128 detects an approaching advertising signature 12. Sensor 128 then relays a signal to controller 80, which in turn activates the clutch 136 so that drive rollers 70 and 74 advance the elongated repositionable sheeting 54 forward until sensor 78 detects an eye mark 79 on the back side 32 of elongated repositionable sheeting 54. Sensor 78 relays a signal to controller 80, which in turn activates brake 138. After brake 138 has been activated, cutting mechanism 60 is activated to cut the elongated repositionable sheeting 54. Endless belt 116 moves the cut sheet 14 beneath blower 118 where it is temporarily supported by a vacuum until sensor 128 detects an advancing signature 12. Sensor 128 then sends a signal to controller 80 to tell the air valve 114 to open to activate the blower 118 to force the cut sheet 14 onto the preceding advertising signature 12 to form an advertising insert 10. Advertising insert 10 exits apparatus 40 and may be transported to a bindery. This process is repeated over again to adhere each cut repositionable sheet 14 to an advertising signature.

Figure 12:
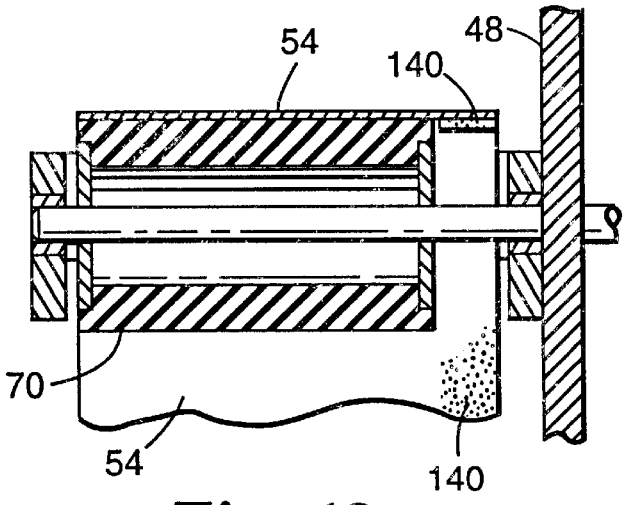
FIG. 12 is a cross section of drive roller 70 in accordance with the present invention taken along lines 12—12 of FIG. 6.

As best shown in FIG. 4 and particularly in FIG. 11, apparatus 40 is designed so that the RPSA 140 of elongated, linerless repositionable sheeting 54 makes very little contact with apparatus 40. As the elongated, linerless repositionable sheeting 54 comes off the supply roll 52, the adhesive bearing side 56 is positioned away from idler rollers 64 and 66. The adhesive bearing side 56 of elongated, linerless repositionable sheeting 54 is also disposed outwardly from pinch roller 68. When the elongated, linerless repositionable sheeting 54 travels over drive roller 70, the RPSA 140 is facing the drive roller 70; however, as best shown in FIG. 12, the RPSA 140 does not make contact with drive roller 70. The RPSA 140 is disposed on the backside 56 of sheeting 54 as a narrow band along one edge. The narrow band of adhesive 140 extends longitudinally in the direction of sheeting advancement and is offset or disposed laterally from drive roller 70 so that it does not come into contact therewith. Although drive roller 70 makes contact with a substantial portion of the backside 56 of sheeting 54, it does not contact with the elongated, linerless repositionable sheeting 54 where the adhesive 140 is located. Having the drive roller 70 and RPSA 140 positioned relative to each other as such, the drive roller 70 is able to advance the elongated, linerless repositionable sheeting 54 without having the adhesive 140 come into contact with roller 70. RPSA 140 on the backside 56 of cut sheet 14 also faces endless belt 116. The band of RPSA 140 also can be offset or disposed laterally from the endless belt 116 to avoid contact therewith. Thus, the only place in apparatus 40 where the adhesive 70 can contact apparatus 40 is on rail 106 of precutting guide 92 shown in FIG. 7. Rail 106, however, has a minimal surface area and is coated with polytetrafluoroethylene to minimize frictional contact between RPSA 140 and rail 106. Further, the second drive roller 74 carries a substantial portion of the weight of the elongated repositionable sheeting 54 at the precutting guide 92 to prevent the sheeting from adhering to rail 106. If desired, rail 106 also could be offset or disposed laterally from the narrow band of adhesive 140 to preclude contact therewith. Thus, an apparatus of the invention is able to apply linerless cut sheets to advertising signatures in a manner that precludes the RPSA from making substantial contact or any contact with the apparatus, thereby preventing the adhesive from interfering with or frustrating the process of applying linerless sheets to advertising signatures.

Although the apparatus of the invention has been shown in the above description to be useful for adhering cut repositionable sheets directly to advertising signatures, the apparatus may be useful for adhering cut repositionable sheets directly to other substrates such as magazine covers, books, letters, packaging, et cetera. The invention thus may take on various modifications and alterations without departing from the spirit and scope thereof. Accordingly, it is to be understood that this invention is not to be limited to the above-described, but is to be controlled by the limitations set forth in the following claims and any equivalents thereof.

What is claimed is:

1. In a wound roll of linerless sheet material, wherein the sheet material of the roll is elongated longitudinally, has first and second major opposed sheet surfaces, first and second opposed side edges and a repositionable pressure-sensitive adhesive extending longitudinally and covering laterally only a portion of the first sheet surface of the sheet material, the improvement which comprises:

(a) the portion of the first sheet surface bearing the repositionable pressure-sensitive adhesive is a single narrow band extending along only the first side edge of the sheet material, the narrow band having a lateral width substantially less than half of the lateral width of the entire sheet;

(b) the second sheet surface of the sheet material being free of adhesive;

(c) the sheet material of the roll is free from perforations therethrough, continuous and without pre-separated lines, and adapted to be cut into identical discrete sheets; and (d) a plurality of equally longitudinally spaced and detectable indicia disposed on the first sheet surface of the sheet material, the spacing between two adjacent indicia defining a longitudinal sheet dimension, the indicia having sufficient visual contrast from the sheet material to be readily visually detectable upon viewing the first sheet surface of the sheet material when the first sheet surface is directly viewable, wherein the sheet material is opaque and the indicia on the first sheet surface are substantially visually undetectable upon viewing the second sheet surface.

2. The invention of claim 1 wherein the indicia are identical.

3. The invention of claim 1 wherein the indicia are disposed adjacent the second side edge of the sheet material.

4. The invention of claim 1 wherein the adhesive covers only a minor portion of the first sheet surface.

5. The invention of claim 1 wherein the adhesive has an adhesion of 10 to 250 g/cm.

6. The invention of claim 1 wherein the adhesive has a shear of at least five minutes.

7. The invention of claim 1 wherein the adhesive includes additives selected from the group consisting of pigments, fillers, stabilizers and polymeric additives.

8. The invention of claim 1, and further comprising (a) a primer layer between the first sheet surface of the sheet material and the adhesive.

9. The invention of claim 1 wherein the sheet material is selected from the group consisting of paper, plastic film, cellulose acetate, ethyl cellulose, woven or nonwoven fabric formed of synthetic or natural material, metal, metallized polymeric film, ceramic sheet and combinations thereof.

10. In a wound roll of linerless sheet material, wherein the sheet material of the roll is elongated longitudinally, has first and second major opposed sheet surfaces, first and second opposed side edges and a repositionable pressure-sensitive adhesive extending longitudinally and covering laterally only a portion of the first sheet surface of the sheet material, the improvement which comprises:

(a) the portion of the first sheet surface bearing the repositionable pressure-sensitive adhesive is a single narrow band extending along only the first side edge of the sheet material;

(b) the second sheet surface of the sheet material being free of adhesive;

(c) the sheet material of the roll is free from perforations therethrough;

(d) a plurality of equally longitudinally spaced and detectable indicia disposed on the first sheet surface of the sheet material, the spacing between two adjacent indicia defining a longitudinal sheet dimension, the indicia having sufficient visual contrast from the sheet material to be readily visually detectable upon viewing the first sheet surface of the sheet material only as it is unwound from the roll; and (e) a plurality of equally longitudinally spaced, identical images disposed on the second sheet surface of the sheet material.

11. The invention of claim 1 wherein the first sheet surface of the sheet material is aligned to face the axis of the roll.

12. The invention of claim 10 wherein the indicia on the first sheet surface and the images on the second sheet surface are different.

13. A wound roll of linerless sheet material, wherein the sheet material of the roll is elongated longitudinally, free from perforations therethrough, and has first and second major sheet surfaces and first and second opposed side edges, the roll of sheet material comprising:

a repositionable pressure-sensitive adhesive aligned on only a single longitudinally narrow extending strip portion of the first sheet surface of the sheet material, adjacent the first side edge thereof;

a plurality of equally longitudinally spaced and detectable indicia disposed on the first sheet surface of the sheet material, adjacent the second side edge thereof, the indicia having sufficient visual contrast from the sheet material to be readily visually detectable upon viewing the first sheet surface of the sheet material only as it is unwound from the roll; and a plurality of identical images disposed on the second sheet surface of the sheet material wherein the images are equally longitudinally spaced apart the same distance as the indicia on the first sheet surface of the sheet material, and wherein each of the images is different from each of the indicia.

14. In a wound roll of linerless sheet material, wherein the sheet material of the roll is elongated longitudinally, has first and second major opposed sheet surfaces, first and second opposed side edges and a repositionable pressure-sensitive adhesive extending longitudinally on only a portion of the first sheet surface of the sheet material, the improvement which comprises:

the portion of the first sheet surface bearing repositionable pressure-sensitive adhesive is a single narrow band extending along only the first side edge of the sheet material;

a plurality of equally longitudinally spaced and detectable indicia disposed on the first sheet surface of the sheet material, the indicia having sufficient visual contrast from the sheet material to be readily visually detectable upon viewing the first sheet surface of the sheet material as it is unwound from the roll;

the sheet material of the roll being free of a liner, opaque and free from perforations therethrough;

a primer layer between the first sheet surface of the sheet material and the adhesive; and a plurality of identical images disposed on the second sheet surface of the sheet material, wherein the images on the second sheet surface are different from the indicia on the first sheet surface and are equally longitudinally spaced apart the same distance as the indicia on the first sheet surface of the sheet material, and wherein the sheet material of the roll is adapted to be cut laterally into a plurality of discrete longitudinal repositionable sheets with the indicia and images on each opposed sheet surface being identically longitudinally and laterally aligned, relative to each other and relative to every other sheet cut from the sheet material.

15. The invention of claim 13 wherein the sheet material is opaque.

16. A roll of linerless sheet material, wherein the sheet material of the roll is elongated longitudinally, free from perforations therethrough, continuous and without pre-separated lines, adapted to be cut into identical discrete sheets, and has first and second major sheet surfaces, and first and second side edges of the sheet material, the roll of sheet material comprising:

a repositionable pressure-sensitive adhesive covering laterally only a portion of the first sheet surface of the sheet material along the first side edge of the sheet material, the adhesive bearing portion having a lateral width substantially less than half of the lateral width of the entire sheet;

a plurality of equally longitudinally spaced and optically detectable indicia disposed on either the first or second sheet surface of the sheet material along the second side edge of the sheet material, each indicum having a perimeter and sufficient optical contrast from the surface surrounding the indicum to be readily optically detectable upon viewing the indicia bearing sheet surface of the sheet material, each indicum further having a position on the indicia bearing sheet surface, the position being defined by a longitudinal coordinate and a lateral coordinate, the longitudinal coordinates of two adjacent indicia defining a uniform longitudinal sheet dimension, the lateral coordinates of the indicia being substantially uniform and resulting in a row of indicia extending longitudinally on the roll, each indicum further having a longitudinal indicum dimension which is substantially smaller than the longitudinal sheet dimension, and the position and the geometric shape of each indicum is capable of defining a unique lateral cutting position with a meaningful precision using a photodetector scanning over the row of indicia in the longitudinal direction so that as the roll of sheet material is cut laterally at each cutting position, identical discrete sheets will be formed.

17. The invention of claim 16 wherein the indicia are disposed on the first sheet surface.

18. A roll of linerless sheet material, wherein the sheet material of the roll is elongated longitudinally, free from perforations therethrough, and has first and second major sheet surfaces, the roll of sheet material comprising:

a repositionable pressure-sensitive adhesive covering laterally only a portion of the first sheet surface of the sheet material, a plurality of equally longitudinally spaced and optically detectable indicia disposed on either the first or second sheet surface of the sheet material, the indicia having sufficient optical contrast from the sheet material to be readily optically detectable upon viewing the indicia bearing sheet surface of the sheet material, each indicum having a position on the indicia bearing sheet surface, the position being defined by a longitudinal coordinate and a lateral coordinate, the longitudinal coordinates of two adjacent indicia defining a longitudinal sheet dimension, each longitudinal sheet dimension being uniform with the indicia being equally longitudinally spaced, the lateral coordinates of the indicia being substantially uniform and resulting in a row of indicia extending longitudinally on the roll and laterally substantially uniform, each indicum further having a longitudinal dimension which is substantially smaller than the longitudinal sheet dimension so that the position of each indicum defines a unique lateral cutting position with reasonable precision; and a plurality of identical images disposed on the sheet surface opposite to the indicia bearing sheet surface, wherein the images are equally longitudinally spaced, wherein upon viewing the indicia bearing sheet surface each of the images does not contain a portion that is both optically indistinct from an adjacent indicum and has a lateral coordinate substantially the same as the lateral coordinate of the indicum.

19. The invention of claim 18, wherein the sheet material of the roll being opaque so that the images are substantially optically undetectable upon viewing on the indicia bearing sheet surface.

20. The invention of claim 16, wherein the sheet material of the roll being opaque so that the indicia are substantially optically invisible upon viewing on the image bearing sheet surface.

21. The invention of claim 16, wherein the longitudinal indicum dimension is less than one-fourth of the longitudinal sheet dimension.

22. The invention of claim 16, wherein an indicum is a small solid mark contrasting to the sheet material.

23. The invention of claim 16, wherein an indicum is a small area of the original surface of the sheet material, the area being contrasted by an optically detectable mark at the perimeter of the indicum.

24. The invention of claim 16, wherein the row of indicia is straight and uniform, along which row optical contrast remains substantially constant except at the perimeter of each indicum.

25. In a wound roll of linerless sheet material, wherein the sheet material of the roll is elongated longitudinally, has first and second major opposed sheet surfaces, first and second opposed side edges and a repositionable pressure-sensitive adhesive extending longitudinally on only a portion of the first sheet surface of the sheet material, the improvement which comprises:

the portion of the first sheet surface bearing repositionable pressure-sensitive adhesive is a single narrow band extending along only the first side edge of the sheet material, a plurality of equally longitudinally spaced and detectable indicia disposed on the first or the second sheet surface of the sheet material, the indicia having sufficient visual contrast from the sheet material to be readily visually detectable upon viewing the first sheet surface of the sheet material as it is unwound from the roll;

the sheet material of the roll being free of a liner, opaque, and free from perforations therethrough;

a primer layer between the first sheet surface of the sheet material and the adhesive; and a plurality of identical images disposed on the sheet surface opposite to the indicia bearing sheet surface, wherein the images are different from the indicia and are equally longitudinally spaced apart the same distance as the indicia, and wherein the sheet material of the roll is adapted to be cut laterally into a plurality of discrete and longitudinal repositionable sheets with the indicia and images on each opposed sheet surface being identically longitudinally and laterally aligned, relative to each other and relative to every other sheet cut from the sheet material.

* * * * *